US005272499A

United States Patent [19]

Yamada

[11] Patent Number: 5,272,499

[45] Date of Patent: Dec. 21, 1993

[54] PHOTOGRAPHIC SILVER HALIDE PHOTOSENSITIVE MATERIAL PROCESSING APPARATUS

[75] Inventor: Minoru Yamada, Kanagawa, Japan

[73] Assignee: Fuji Photo Film Co., Ltd., Kanagawa, Japan

[21] Appl. No.: 838,212

[22] PCT Filed: Jul. 9, 1991

[86] PCT No.: PCT/JP91/00915

§ 371 Date: May 5, 1992

§ 102(e) Date: May 5, 1992

[87] PCT Pub. No.: WO92/01244

PCT Pub. Date: Jan. 23, 1992

[30] Foreign Application Priority Data

Jul. 9, 1990 [JP] Japan ..... 2-181048

[51] Int. Cl.[5] ..... G03D 3/08

[52] U.S. Cl. ..... 354/319; 354/324

[58] Field of Search ..... 354/323, 320, 324, 319

[56] References Cited

U.S. PATENT DOCUMENTS 4,987,438 1/1991 Goto et al. ..... 354/314
5,019,850 5/1991 Ishikawa et al. ..... 354/324 X

FOREIGN PATENT DOCUMENTS 0254928 2/1988 European Pat. Off. .
0355034 2/1990 European Pat. Off. .
3423671 6/1984 Fed. Rep. of Germany .
63-129343 6/1988 Japan .
63-187243 8/1988 Japan .
1-319745 12/1989 Japan .
2-39150 2/1990 Japan .
3-134666 6/1991 Japan .

*Primary Examiner*—D. Rutledge
*Attorney, Agent, or Firm*—Sughrue, Mion, Zinn, Macpeak & Seas

[57] ABSTRACT

Photographic silver halide photosensitive material is processed through a series of juxtaposed processing tanks charged with processing solutions while feeding respective replenishers in accordance with the quantity of photosensitive material processed. A crossover roller is located between each pair of processing tanks for carrying the photosensitive material and a rinsing tank is filled with cleaning water in which the crossover roller is at least partially immersed. At least a portion of the cleaning water fed to each rinsing tank is used as at least a portion of diluent water necessary to dilute a replenisher concentrate for the processing solution in the processing tank located forward of each rinsing tank. This arrangement can reduce the amount of developer and fixer replenishers fed and hence, the amount of spent solutions. The crossover rollers are cleaned fully without any extra cleaning operation, leading to ease of maintenance. The overall amount of water used is reduced. Further, photographic performance is excellent as evidenced by the elimination of physical development irregularities while the apparatus is of compact size and solution preparation is easy.

10 Claims, 5 Drawing Sheets

PHOTOGRAPHIC SILVER HALIDE PHOTOSENSITIVE MATERIAL PROCESSING APPARATUS

DESCRIPTION

1. Field of the Invention

This invention relates to an apparatus for processing photographic silver halide photosensitive material (sometimes abbreviated as photosensitive material, hereinafter).

2. Background of the Invention

Black-and-white photosensitive material after exposure is processed through a series of steps including black-and-white development, fixation, and washing while color photosensitive material after exposure is processed through a series of steps including color development, desilvering, washing, and stabilization.

There are used black-and-white developer for black-and-white development, fixer for fixation, color developer for color development, bleaching, blix and fixing solutions for desilvering, city water or deionized water for washing, and stabilizer for stabilization.

Photosensitive material is processed by dipping it in the respective processing solutions which are normally adjusted to a temperature of 30° to 40° C.

These steps are generally performed by means of a processing apparatus, typically automatic processor. The running process (continuous process) using such a processing apparatus generally relies on a replenisher mode of making up a replenisher in accordance with the quantity of photosenstivie material processed for maintaining the activity of the processing solution constant.

In this regard, crossover rollers are disposed above or between the processing tanks for carrying forward the photosensitive material.

As mentioned above, the processing tanks are filled with processing solutions having different functions or compositions. On passage of the photosensitive material across the crossover rollers, the processing solutions adhere to the crossover rollers, causing contamination.

For overcoming this and other problems, it has been employed to clean crossover rollers.

Included are a method of removing crossover rollers from an automatic processor and manually cleaning them everyday prior to the onset of processing for preventing any contaminant on the crossover rollers from adhering to the surface of photosensitive material to be first processed, and a method of injecting cleaning water against crossover rollers at the end of operation (Japanese Patent Application Kokai (JP-A) No. 187243/1988).

The former method of removing crossover rollers for cleaning has been widely used in the art. However, cleaning must be done at a limited time and the need for roller removal is cumbersome. The latter method of injecting cleaning water against crossover rollers cannot fully remove contaminants because the amount of cleaning water injected is limited.

A further approach is to provide a rinsing bath in conjunction with a crossover roller for always cleaning the roller with water.

This approach of using a rinsing bath is effective for fully cleaning the crossover roller. Not only sufficient cleaning action is ensured, but the location of a rinsing bath between developing and fixing tanks prevents the occurrence of development irregularities (physical development irregularities) caused by fixer penetrating into the photosensitive material being processed before developer components are fully dissolved away therefrom. Further, The replenisher used therein is conventionally prepared by using a replenisher concentrate consisting of one or more parts, more particularly, by adding water to a predetermined amount of concentrate and agitating them by means of a chemical mixer or the like to form a dilute solution.

However, this replenisher preparation method requires a stock tank of a large volume for storing the replenisher, which is undesirable in these days when a compact apparatus is needed.

Under these circumstances, the applicant previously proposed

"a method for replenishing a processing solution having a plurality of partial stocks diluted with a diluent to a processing tank, characterized by comprising the steps of:

providing a cartridge having discrete compartments partitioned therein and filled with the partial stocks in amounts corresponding to a desired mix proportion of the partial stocks, transferring the partial stocks from the cartridge compartments into discrete compartments partitioned in a stock tank, respectively, and delivering the partial stocks from the tank compartments in amounts corresponding to the desired mix proportion of the partial stocks to the processing tank along with the diluent." (Japanese Patent Application No. 273304/1989).

This method has the advantage that since the replenisher is received in the stock tank without diluting with water, the stock tank can be accordingly reduced in volume.

A processing apparatus as mentioned above is adapted to process photosensitive material by sequentially carrying it through processing tanks filled with respective processing solutions. since the proportion of the developer dragged into the fixer is reduced, the fixer undergoes only a slight pH rise and maintains its film hardening capability high. Furthermore, cleaning efficiency can be increased by providing another rinsing bath between fixing and washing tanks. In connection with the fixing tank where silver is often recovered from the fixer by electrolysis or the like, it is also known that the silver recovery is improved by channeling an overflow of the rinsing bath to the fixing tank. In particular, the method of providing a rinsing bath and channeling the rinsing solution to the fixing tank as mentioned above is believed advantageous for silver recovery in the water saving mode of washing because the rinsing solution having a high concentration of silver is fed back to the fixer (JP.A 129343/1988).

Thus, the method of using a rinsing bath is satisfactory with respect to crossover roller cleaning and photographic performance, but increases a spent solution load.

That is, as the replenishment amount is reduced in accordance with the recent demand for a reduced amount of processing solution used, the necessity of fully cleaning the crossover roller is increased, resulting in an increased amount of rinsing solution used, which offsets the benefit of the reduced replenishment.

Therefore, there is a need for improvement in this regard.

DISCLOSURE OF THE INVENTION

An object of the present invention is to provide a photographic silver halide photosensitive material processing apparatus which can reduce the amount of processing solution used, fully clean a crossover roller, and ensure ease of maintenance, while providing images of improved photographic properties.

This and other objects are achieved by the present invention defined below as (1) to (10).

(1) An apparatus for processing a photographic silver halide photosensitive material with a processing solution while feeding a replenisher in accordance with the quantity of photosensitive material processed, characterized by comprising a plurality of processing tanks each filled with a processing solution for processing the photosensitive material, a crossover roller between the processing tanks for carrying the photosensitive material, and a rinsing tank filled with cleaning water in which said crossover roller is at least partially immersed, wherein at least a portion of the cleaning water fed to said rinsing tank is used as at least a portion of diluent water necessary to dilute a replenisher concentrate therewith for forming a replenisher to be fed to the processing tank located forward of said rinsing tank.

(2) The photographic silver halide photosensitive material processing apparatus of (1) wherein said plurality of processing tanks include developing, fixing and washing tanks, the crossover roller and the rinsing tank are disposed between each pair of processing tanks.

(3) The photographic silver halide photosensitive material processing apparatus of (2) wherein the amount of the replenisher fed for the developer is up to 0.4 liters per square meter of the photosensitive material.

(4) The photographic silver halide photosensitive material processing apparatus of (3) wherein the mixing ratio of a replenisher concentrate to the diluent water for the developer replenisher is such that the volume ratio of replenisher concentrate to diluent water may range from 1/0.4 to 1/5.

(5) The photographic silver halide photosensitive material processing apparatus of (2) wherein the amount of the replenisher fed for the fixer is up to 0.4 liters per square meter of the photosensitive material.

(6) The photographic silver halide photosensitive material processing apparatus of (5) wherein the mixing ratio of a replenisher concentrate to the diluent water for the fixer replenisher is such that the volume ratio of replenisher concentrate to diluent water may range from 1/0.4 to 1/5.

(7) The photographic silver halide photosensitive material processing apparatus of any one of (1), (2), (3) and (5) wherein the cleaning water constitutes 5 to 100% of the diluent water necessary to dilute a replenisher concentrate.

(8) The photographic silver halide photosensitive material processing apparatus of any one of (1), (2), (3) and (5) wherein the washing water is replenished in an amount of up to 3 liters per square meter of the photosensitive material.

(9) The photographic silver halide photosensitive material processing apparatus of (2) which includes a drying section disposed aft of said washing tank, a crossover roller and a rinsing tank located between said washing tank and said drying section, wherein at least a portion of the cleaning water fed to said rinsing tank is channeled to said washing tank.

(10) The photographic silver halide photosensitive material processing apparatus of (9) wherein the cleaning water constitutes 5 to 100% of the amount of washing water replenished.

According to the present invention, the crossover roller is cleaned with cleaning water in the rinsing tank and at least a portion of the cleaning water is used to dilute a replenisher concentrate to be fed to the processing tank located forward of the rinsing tank. As a result, the crossover roller is cleaned with a portion of water needed for the preparation of the replenisher, ensuring that the crossover roller is fully cleaned without increasing the amount of water used and without increasing the spent solution amount.

Further, maintenance is easy because of the eliminated need for removing the crossover roller.

BEST MODE FOR CARRYING OUT THE INVENTION

Several preferred embodiments of the present invention are described below in conjunction with the drawings.

Figure 1:
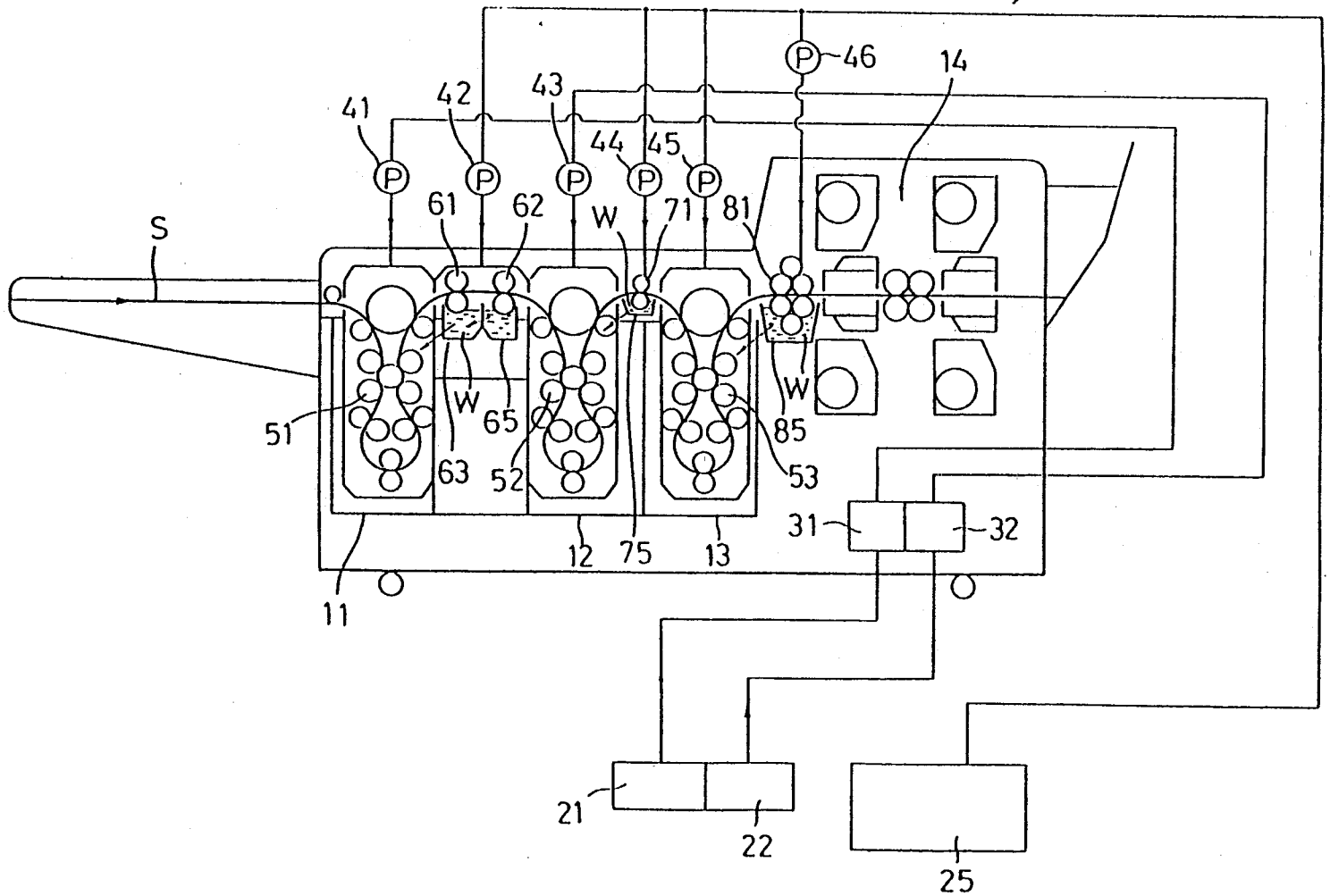
FIG. 1 is a schematic view illustrating one exemplary arrangement of a processing apparatus according to the present invention.

Referring to FIG. 1, there is illustrated one exemplary arrangement of an apparatus for processing a photographic silver halide photosensitive material (sometimes abbreviated as photosensitive material, hereinafter) according to the present invention.

The illustrated apparatus is of the roller conveyor type wherein a sheet of photosensitive material is carried forward by means of rollers.

As shown in FIG. 1, the apparatus 1 includes a main housing which accommodates therein a developing tank 11, a fixing tank 12, and a washing tank 13 which are filled with developer, fixer and washing water, respectively.

In developing tank 11 are arranged conveyor rollers 51 for carrying photosensitive material S along a predetermined path in the tank. Also in fixing and washing tanks 12 and 13 are arranged similar conveyor rollers 52 and 53, respectively.

Aft of washing tank 13 is located a drying section 14 for drying photosensitive material S which has been subject to development, fixation and washing.

The apparatus 1 includes a replenishing container 21 for storing developer replenisher concentrate and a replenishing container 22 for storing fixer replenisher concentrate which are coupled to stock tanks 31 and 32, respectively, so that respective replenishers are reserved in stock tanks 31 and 32.

The apparatus 1 further includes a water tank 25 for storing water Water may be fed to tank 25 in a non-piping system using tank 25 as a separate water tank or tank 25 may serve as a reservoir adapted to receive city water directly.

Figure 2:
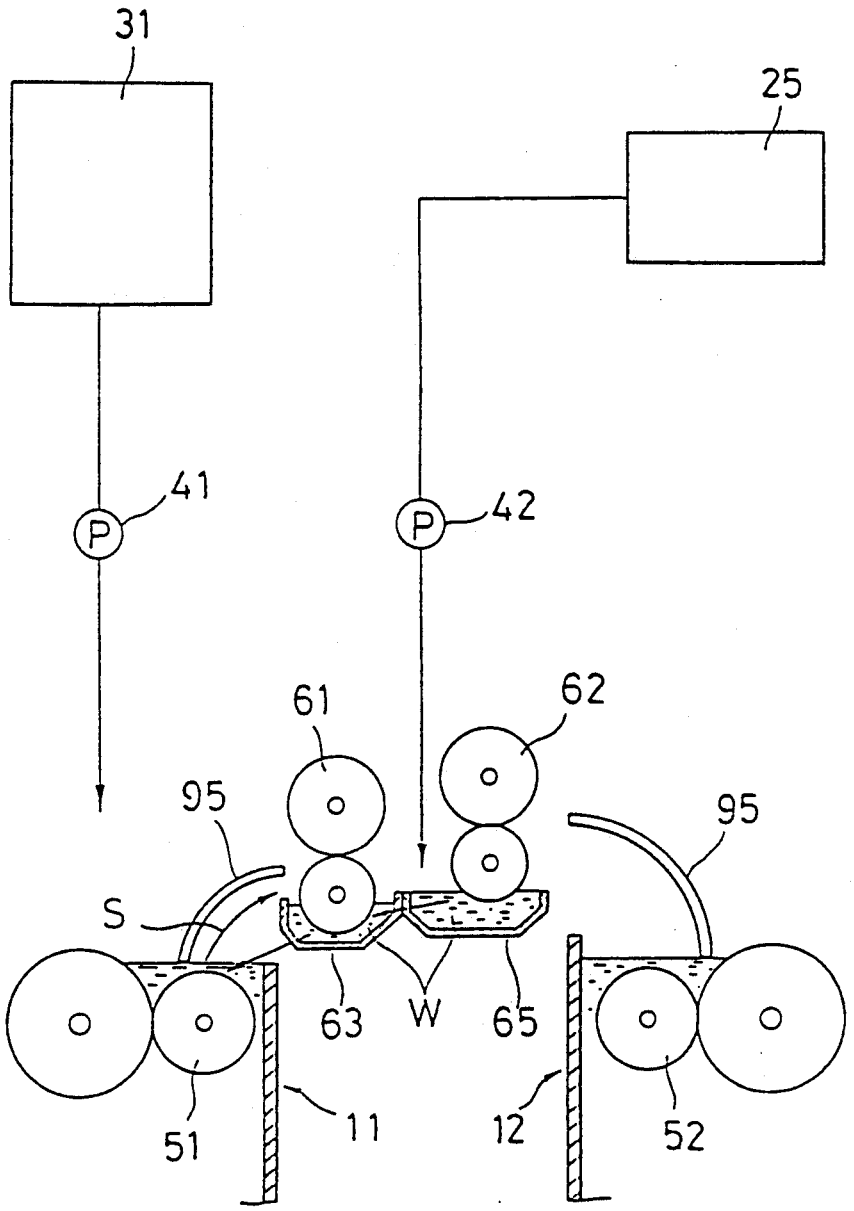
FIG. 2 is an enlarged cross-sectional view of a crossover roller section in FIG. 1

As shown in FIGS. 1 and 2, between developing and fixing tanks 11 and 12 are located crossover rollers 61 and 62 for carrying photosensitive material S from developing tank 11 to fixing tank 12.

Between these tanks, a rinsing tank 63 is disposed below crossover roller 61 and a rinsing tank 65 disposed below crossover roller 62 The rinsing tanks 63 and 65 are filled with cleaning water W, and crossover rollers 61 and 62 are at least partially immersed in cleaning water W in rinsing tanks 63 and 65, respectively.

The crossover rollers 61 and 62 are adapted to clamp photosensitive material S which has been carried thereat by means of conveyor rollers 51 and a guide 95, and squeeze off the developer dragged along with photosensitive material S, thereby preventing drag-out of the developer by photosensitive material S which is carried into the fixing tank 12 in company with another guide 95 and conveyor rollers 52. Therefore, the developer adheres to crossover rollers 61 and 62, which are cleaned with cleaning water W in rinsing tanks 63 and 65, respectively.

The tanks are sequentially channeled such that during processing operation, cleaning water W is supplied from water tank 25 to rinsing tank 65 through a pump 42, an overflow of rinsing tank 65 is channeled to rinsing tank 63, and an overflow of rinsing tank 63 is channeled to developing tank 11 (see arrows in the figures).

Provision is made such that the developer replenisher is supplied from developer stock tank 31 to developing tank 11 through a pump 41 in synchronization with entry of rinsing tank overflow into developing tank 11.

As shown in FIG. 1, a crossover roller 71 and a rinsing tank 75 of the same structure as above are located between fixing and washing tanks 12 and 13 such that crossover roller 71 is cleaned with cleaning water W in rinsing tank 75.

Again, the tanks are channeled such that during processing operation, cleaning water W is supplied from water tank 25 to rinsing tank 75 through a pump 44 and an overflow of rinsing tank 75 is channeled to fixing tank 12. And provision is made such that the fixer replenisher is supplied from fixer stock tank 32 to fixing tank 12 through a pump 43 in synchronization with entry of rinsing tank overflow into fixing tank 12.

Additionally, between washing tank 13 and drying section 14 is located a squeeze roller 81 which is at least partially immersed in cleaning water W in a rinsing tank 85 so that roller 81 is cleaned with the cleaning water W.

Again, the tanks are channeled such that during processing operation, cleaning water W is supplied from water tank 25 to rinsing tank 85 through a pump 46.

The tanks are also channeled such that an overflow of rinsing tank 85 is channeled to washing tank 13. Here again, provision is made such that a washing water replenisher is supplied from water tank 25 to washing tank 13 through a pump 45 in synchronization with entry of rinsing tank overflow into washing tank 13.

When it is desired to wash with a sufficient amount of water (at least 3 liters of water per square meter of photosensitive material), washing water may be directly fed from the city water line to washing tank 13 and parts thereof bypassed to rinsing tanks 85 and 75.

It is understood that solution flows are schematically indicated by arrows in FIG. 1.

Additionally, the apparatus 1 includes overflow ports, agitation means, circulation means, and other means appropriately arranged, if necessary, although they are not shown.

It is to be noted that conveyor rollers 51 to 53 and guides are preferably assembled into a rack with which each processing tank is loaded.

Then, with the above-mentioned construction, photosensitive material S after exposure is carried into developing tank 11 and passed through the tank by way of conveyor rollers 51 where it is developed with the developer.

The photosensitive material S which has been conveyed out of developing tank 11 is clamped and carried forward by crossover rollers 61 and 62 disposed between developing and fixing tanks 11 and 12. At this point, the developer adheres to crossover roller 61 which is cleaned with cleaning water W in rinsing tank 63 and to crossover roller 62 which is cleaned with cleaning water W in rinsing tank 65.

At the onset of processing of photosensitive material S, the developer replenisher is replenished to developing tank 11 from stock tank 31 through pump 41. An overflow of rinsing tank 63 is channeled to developing tank 11 in synchronization with entry of developer replenisher into developing tank 11, because cleaning water W is fed from water tank 25 to rinsing tank 65 through pump 42 so as to induce such an overflow.

At this point, sufficient agitation should be done in developing tank 11.

The replenisher in stock tank 31 may be in concentrate form as received from replenishing container 21 having replenisher concentrate stored therein or in diluted form by somewhat diluting the replenisher concentration with water fed from water tank 25.

In this regard, the relationship of the quantity of photosensitive material S processed and the amount of developer replenisher and the relationship of the amount of replenisher concentrate to the amount of diluent water may be determined in advance and set in the system.

More particularly, since a portion of diluent water is fed to rinsing tank 65 for cleaning the crossover roller and overflowed therefrom, the concentration of the replenisher in stock tank 31 may be set so as to meet the relationships.

In this regard, it is acceptable to dilute the replenisher concentrate from stock tank 31 solely with the overflow, to dilute the replenisher concentrate in stock tank 31 with water from water tank 25 and further with the overflow, or in some cases, to directly feed water from water tank 25 to developing tank 11 to supplement a shortage of dilution with the overflow.

In the practice of the invention, the amount of developer replenisher fed to developing tank 11 (the amount of diluted replenisher concentrate) may be up to 0.4 liters per square meter of photosensitive material, and 5 to 100% by volume, preferably 10 to 100% by volume of the diluent water necessary to dilute the replenisher concentrate in replenishing container 21 may be used as cleaning water W to be replenished to rinsing tank 65.

The mixing ratio of the amount of replenisher concentrate to the combined amount of diluent water for the developer replenisher is preferably such that the volume ratio of replenisher concentrate to diluent water may range from 1/0.4 to 1/5, especially from 1/0.5 to $\frac{1}{4}$.

Using rinsing tanks 63 and 65 to clean crossover rollers 61 and 62 ensures satisfactory cleaning of crossover rollers 61 and 62.

As a result, contamination of the fixer with the developer is prevented.

Also, since the cleaning water W used in cleaning crossover rollers 61 and 62 is supplied to developing tank 11, the amount of water used and therefore, the amount of spent solution can be reduced. In this regard, the amount of water used and therefore, the amount of spent solution is 5 to 100% as compared with the case wherein the cleaning water in the rinsing tank is discarded and fresh water is supplied for the preparation of replenisher.

Preferably, the replenishing container 21 is a single container which is charged with a one-part replenisher concentrate. When the embodiment wherein the concentrate is diluted and mixed with an overflow from rinsing tank 65 in developing tank 11 is employed, the use of a single-part composition provides ease of operation as opposed to a multi-part composition, for example, the need for mixing of replenisher concentrates is eliminated. Then the intervening stock tank 31 may be omitted as the case may be.

Nevertheless, conventional replenisher concentrates for the developer are often available as multi-part compositions, for example, a composition consisting of two parts, one alkaline part containing a developing agent and the other part containing a hardening agent, or a composition consisting of three parts, one part containing a developing agent such as hydroquinones, one part containing an auxiliary developing agent, and one part containing a hardening agent.

In these cases, the replenishing container 21 is partitioned into compartments in accordance with the number of parts, for example, a multi-compartment container.

A multi-part composition may be stored in stock tank 31 either in concentrated mix form or in less concentrated mix form resulting from dilution with a small amount of diluent water while a single-part composition is not an exception.

For these reasons, the multi-part composition is preferably stored in a storage container which is partitioned into compartments having volumes corresponding to the mixing proportion, the compartments being filled with respective parts.

For the detail of such replenishing method, reference is made to the description of the applicant's Japanese Patent Application Nos. 268814/1989 and 273304/1989.

Since stock tank 31 is thus charged with the U replenisher in more or less concentrated form, it can be reduced in volume, leading to a corresponding size reduction of apparatus 1.

As previously described, photosensitive material S is carried by clamping crossover rollers 61, 62 into fixing tank 12 through guide 95 whereupon it is passed through tank 12 by conveyor rollers 52 while it is fixed with the fixer.

Since contamination by the developer is prevented at this stage, the fixer is prevented from exhaustion and thus maintains its processing ability in good condition.

The photosensitive material S which has been conveyed out of fixing tank 11 is clamped and carried forward by crossover roller 71 disposed between fixing and washing tanks 12 and 13. At this point, the fixer adheres to cross over roller 71 which is cleaned with cleaning water W in rinsing tank 75.

In this process, the fixer replenisher is replenished to fixing tank 12 from stock tank 32 through pump 43. In synchronization with entry of fixer replenisher into fixing tank 12, cleaning water W is fed from water tank 25 to rinsing tank 75 through pump 44 and an overflow of rinsing tank 75 is channeled to fixing tank 12.

At this point, sufficient agitation should be done in fixing tank 12.

In this regard, as in the case of the developer, the relationship of the quantity of photosensitive material S processed and the amount of fixer replenisher may be determined in advance and the amount of fixer replenisher fed may be set accordingly.

In the practice of the invention, the amount of fixer replenisher fed to fixing tank 12 may be up to 0.4 liters per square meter of photosensitive material, and 5 to 100% by volume, preferably 10 to 100% by volume of the diluent water necessary to dilute the replenisher concentrate in replenishing container 22 may be used as cleaning water W to be replenished to rinsing tank 75.

The mixing ratio of the amount of a replenisher concentrate to the combined amount of diluent water for the fixer replenisher is preferably such that the volume ratio of replenisher concentrate to diluent water may range from 1/0.4 to 1/5, especially from 1/0.5 to ¼.

The operation associated with stock tank 32 may be in accord with the above-mentioned one for the developer and stock tank 32 may be charged with the fixer concentrate in more or less concentrated form.

The replenisher concentrate in replenishing container 21 for the fixer is preferably of a single-part composition for ease of operation as in the case of the developer.

When a multi-part composition is used, a modification may be made as previously described for the developer.

Again, the stock tank 32 can be reduced in volume.

Using rinsing tank 75 to clean crossover roller 71 ensures satisfactory cleaning of crossover roller 71. Also, the drag-out of the fixer to washing tank 13 is reduced.

Also, since the cleaning water W used in cleaning crossover roller 71 is supplied to fixing tank 12, the amount of water used and therefore, the amount of spent solution can be approximately 5 to 100% as compared with the case wherein fresh water is supplied for both replenisher preparation and roller cleaning.

Further, the percent recovery of silver is increased by channeling cleaning water W in rinsing tank 75 to fixing tank 12.

As previously described, photosensitive material S is carried by clamping crossover roller 71 into washing tank 13 whereupon it is passed through tank 13 by conveyor rollers 53 while it is washed with the washing water.

The photosensitive material S is carried out of washing tank 13 by clamping squeeze roller 81 located between washing tank 13 and drying section 14. At this point, the washing water adheres to squeeze roller 81 which is cleaned with cleaning water W in rinsing tank 85.

Again in this case, an overflow of rinsing tank 85 is channeled to washing tank 13 and used as a replenisher for the washing water If this overflow is not enough to fulfill the replenishment amount, a washing water replenisher may be fed from water tank 25 to washing tank 13 through pump 45 synchronous with the channeling of the overflow.

It will be understood that an overflow occurs as cleaning water W is fed from water tank 25 to rinsing tank 85.

Using rinsing tank 85 to clean squeeze roller 81 ensures that squeeze roller 81 be fully cleaned and the amount of water used be reduced.

In the practice of the invention, the amount of washing water replenisher fed to washing tank 13 may be up to 3 liters per square meter of photosensitive material, and 5 to 100% by volume, preferably 10 to 100% by volume of the washing water replenisher may be used as cleaning water W to be replenished to rinsing tank 85.

In this case again, the amount of water used and therefore, the amount of spent solution can be approximately 5 to 100% as compared with the case wherein fresh water is supplied for cleaning squeeze roller 81.

Thereafter, photosensitive material S is passed through drying section 14 where it is dried, completing the process.

In the practice of the invention, the amount of washing water replenisher fed to washing tank 13 can be as large as 3 liters or more per square meter of photosensitive material. Then a portion of such a large amount of water is fed to rinsing tank 85 and an overflow therefrom is channeled to washing tank 13.

It is to be noted that the arrangement of FIG. 1 employs a non-piping system in which water tank 25 is charged with water for use in processing because this system advantageously eliminates any restriction on the installation of the apparatus.

Although water is differently designated as cleaning water W, washing water, and washing water replenisher in the foregoing description, they are essentially supplied from a common water tank 25.

In this regard, water on storage should preferably be subject to antifungal means.

Further, the arrangement of FIG. 1 is designed such that the developer and fixer replenishers fed from stock tanks 31 and 32 are directly diluted in developing and fixing tanks 11 and 12 with overflows from rinsing tanks 65 and 75, respectively, but the invention is not limited thereto. For example, overflows from rinsing tanks 65 and 75 can be channeled to the feed conduits of respective replenishers, thereby mixing and diluting the replenishers with the overflows midway the conduits. This embodiment is also preferable.

Figure 3:
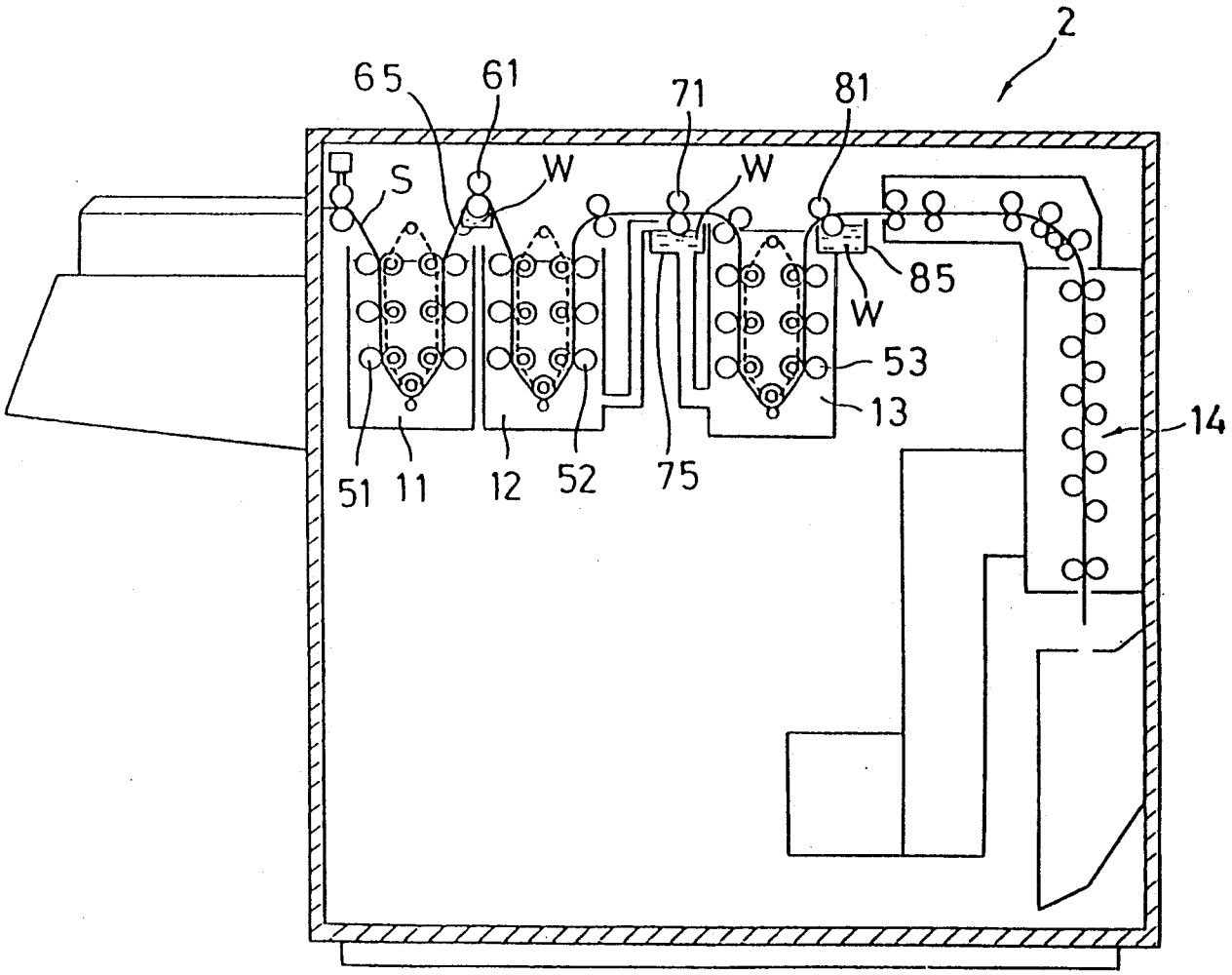
FIGS. 3, 4, and 5 are schematic views illustrating other exemplary arrangements of a processing apparatus according to the present invention.

The apparatus of the present invention is not limited to the arrangement of FIG. 1 and an arrangement as shown in FIG. 3 is also acceptable.

Since the apparatus 2 of FIG. 3 arrangement is not essentially different from the apparatus of FIG. 1 arrangement, elements of like functions are designated by like numerals and the detailed description thereof is omitted. In addition, the apparatus is illustrated with the water tank, stock tanks, replenisher tanks, water supply, and solution flows omitted.

As shown in FIG. 3, apparatus 2 includes rinsing tanks 65, 75, 85 and crossover rollers 61, 71 and squeeze roller 81 of similar construction to those in FIG. 1 located between developing and fixing tanks 11 and 12, between fixing and washing tanks 12 and 13, and between washing tank 13 and drying section 14, respectively.

The differences are that only a pair of crossover rollers 61 are located between developing and fixing tanks 11 and 12; and that rinsing tank 71 between fixing and washing tanks 12 and 13 is channeled to washing tank 13 through a conduit and an overflow of cleaning water W is channeled to fixing tank 12.

The apparatus of the above-mentioned arrangement provides the same benefits as in FIG. 1.

Figure 4:
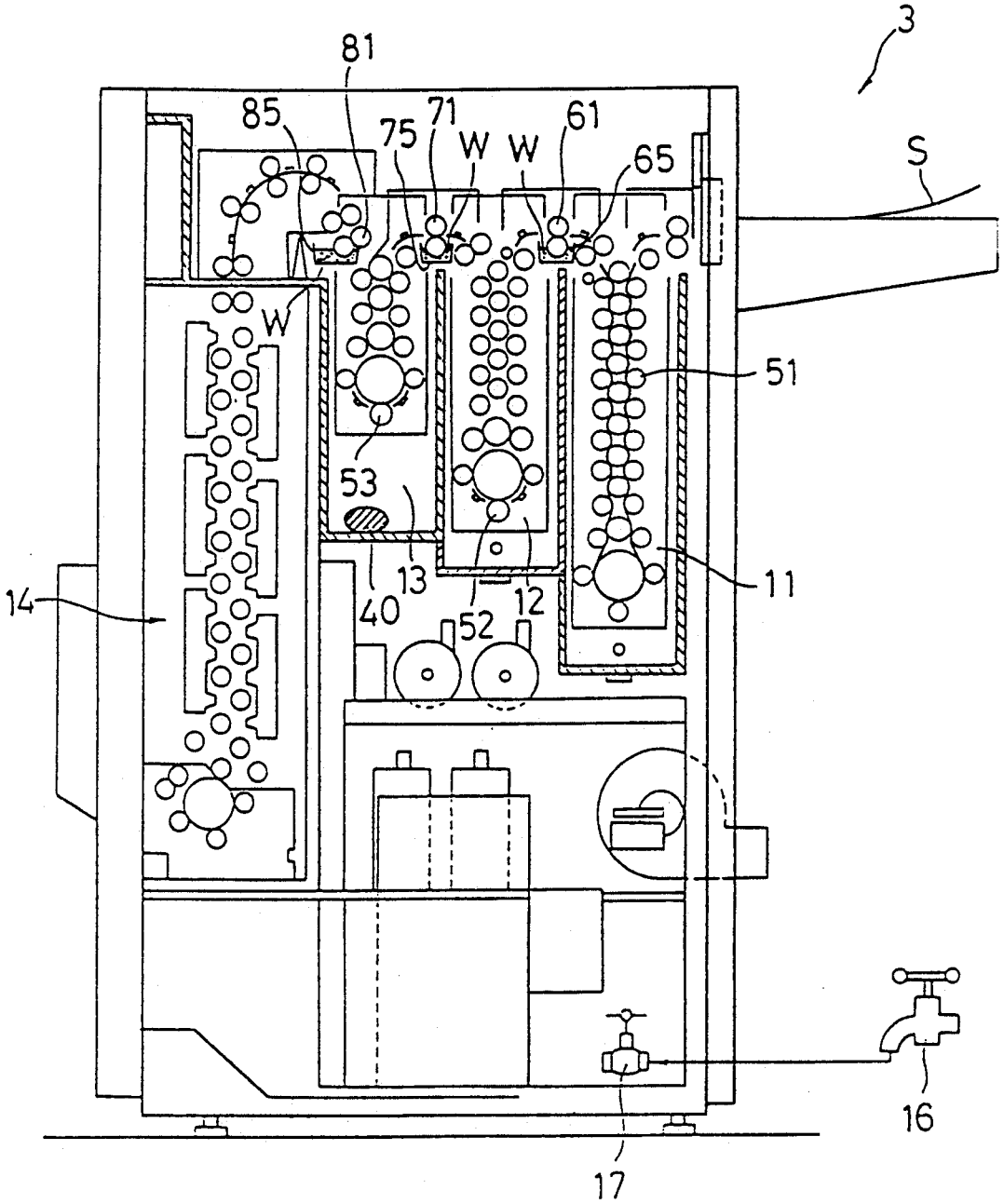

Also, the apparatus of the present invention may be constructed as shown in FIG. 4.

The apparatus 3 shown in FIG. 4 is essentially identical with the apparatus shown in FIG. 1 or 3 except the noticeable difference that it relies on a piping system wherein water for cleaning water W, washing water and replenisher diluting water is supplied through a piping coupled to a city water plug 16 and having a regulator valve 17.

Therefore, elements of like functions are designated by like numerals and the description thereof is omitted.

Also this embodiment includes rinsing tanks 65, 75 and crossover rollers 61, 71 of similar construction to those in FIG. 1 or 3 located between two adjacent ones of tanks 11, 12, 13.

Preferably in washing tank 13 is located silver ion-releasing means or a perforated ozone injector pipe 40 for preventing generation of bio-slime.

Further, squeeze roller 81 and rinsing tank 85 of similar construction to those in FIG. 1 or 3 are located between washing tanks 13 and drying section 14.

The directions indicative of solution flows are not depicted because they may be the same as in FIG. 1.

The apparatus of the above-mentioned arrangement provides the same benefits as the previous embodiments.

Figure 5:
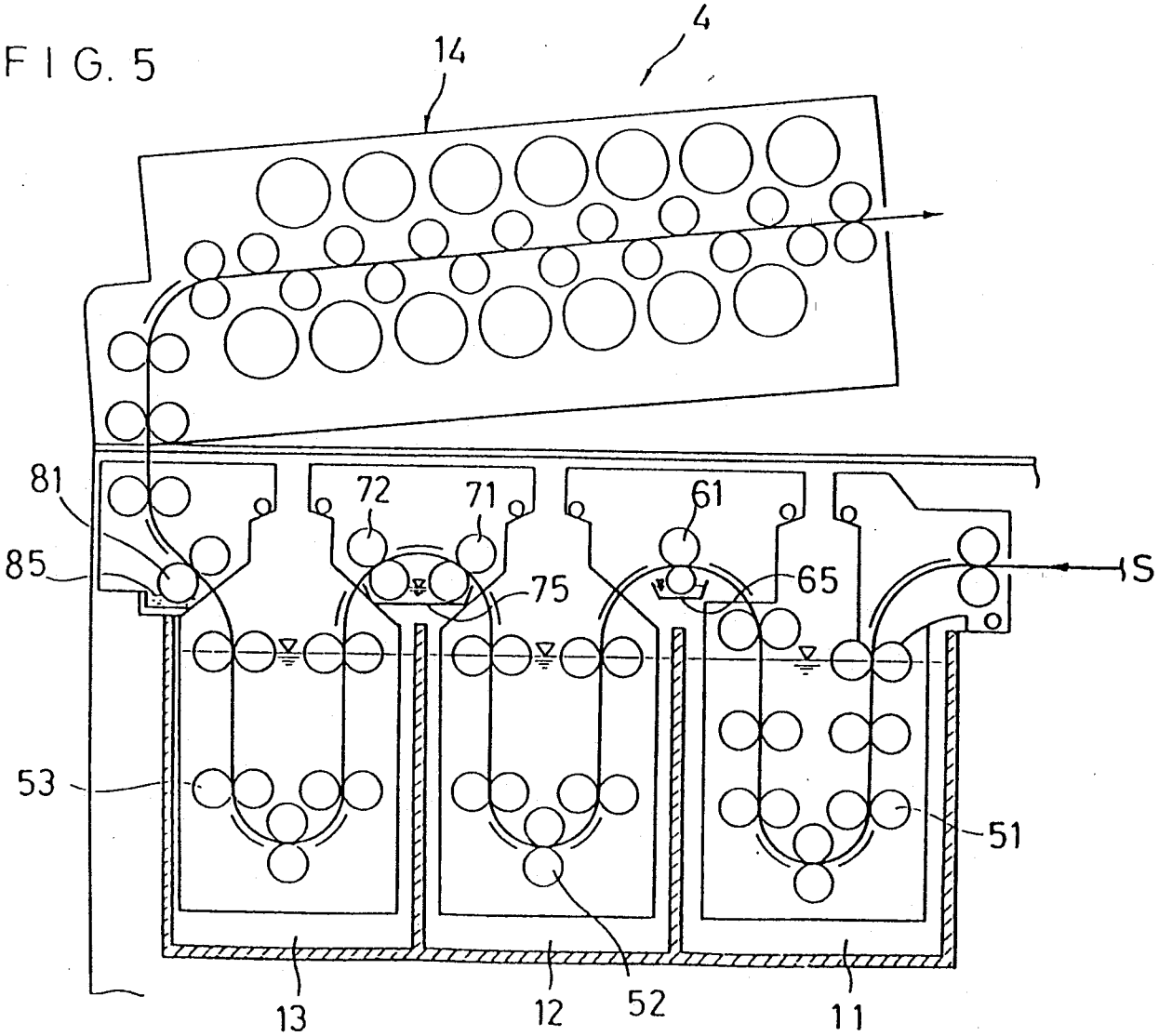

Finally, the apparatus of the present invention may be constructed as shown in FIG. 5.

The apparatus 4 shown in FIG. 5 is essentially identical with the apparatus shown in FIG. 1, 3 or 4 except the noticeable difference that drying section 14 is located above processing tanks 1 to 13.

Therefore, elements of like functions are designated by like numerals and the description thereof is omitted Again, this embodiment includes rinsing tanks 65, 75 and crossover rollers 61, 71, 72 of similar construction to those in FIG. 1, 3 or 4 located between two adjacent ones of tanks 11, 12, 13. Two pairs of crossover rollers 71, 72 are located in rinsing tank 75.

Further, squeeze roller 81 and rinsing tank 85 of similar construction to those in FIG. 1, 3 or 4 are located between washing tanks 13 and drying section 14.

The directions indicative of solution flows are not depicted because they may be the same as in FIG. 1.

The apparatus of the above-mentioned arrangement provides the same benefits as the previous embodiments.

The process of the present invention becomes more effective as the amount of replenisher for a processing solution like a developer or fixer is reduced, particularly when the amount of replenisher is up to 0.4 liters per square meter of photosensitive material. With the replenisher amount reduced so, evaporation of water and spread of odor from the surface in the tanks take place to a non-negligible extent during processing, standby and quiescent periods. Especially the developer undergoes air oxidation and degradation to a larger extent. Therefore, the opening of each processing tank should be as low as possible. Desirable is an opening of up to 50 $cm^2$ per liter of processing solution, more desirably up to 30 $cm^2/1$, most desirably up to 20 $cm^2/1$.

Most photographic photosensitive materials which can be processed in the practice of the present invention are conventional black-and-white photosensitive materials. Particularly useful are ordinary picture taking negative films and black-and-white print papers, laser printer photographic materials and printing photosensitive materials for recording medical images, medical direct radiographic photosensitive materials, medical photofluorographic photosensitive materials, photosensitive materials for recording CRT display images, industrial X-ray photosensitive materials, and the like.

Next, the processing solutions and processing conditions are described.

The developing agent used in the black-and-white developer in the practice of the invention is mainly a hydroquinone while combinations of a hydroquinone with a 1-pheny-3-pyrazolidone or p-aminophenol are preferred for better performance.

Examples of the hydroquinone developing agent used herein include hydroquinone, chlorohydroquinone, bromo hydroquinone, isopropylhyiroquinone, methylhydroquinone, 2,3-dichlorohydroquinone, 2,5-dichlorohydroquinone, 2,3-dibromohydroquinone, and 2,5-dimethylhydroquinone, with the hydroquinone being preferred.

Examples of the p-aminophenol developing agent used herein include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol, with the N-methyl p-aminophenol being preferred.

Examples of the 3-pyrazolidone developing agent used herein include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The hydroquinone developing agent is generally used in an amount of 0.01 to 1.5 mol/liter, preferably 0.05 to 1.2 mol/liter.

In addition to the hydroquinone developing agent, the p-aminophenyl or 3-pyrazolidone developing agent is generally used in an amount of 0.0005 to 0.2 mol/liter, preferably 0.001 to 0.1 mol/liter.

The sulfite preservatives in the black-and-white developer according to the present invention include sodium sulfite, potassium sulfite, lithium sulfite, ammonium sulfite, sodium bisulfite, and potassium metabisulfite. The sulfite is generally used in an amount of at least 0.2 mol/liter, preferably at least 0.4 mol/liter. The preferred upper limit is 2.5 mol/liter.

The black-and-white developer used herein is preferably at pH 8.5 to 13, more preferably pH 9 to 12.

Alkaline agents are used for pH adjustment. Included are pH adjusting agents such as sodium hydroxide, potassium hydroxide, sodium carbonate, potassium carbonate, sodium tertiary phosphate, and potassium tertiary phosphate.

Buffer agents are also useful, for example, borates as disclosed in JP-A 186259/1987, saccharose, acetoxime and 5-sulfosalicylate as disclosed in JP-A 93433/1985, phosphates, and carbonates.

Also used in the developer is a dialdehyde hardening agent or a bisulfite salt adduct thereof, for example, glutaraldehyde or a bisulfate salt adduct thereof.

Additives used other than the above-mentioned components include a development retarder such as sodium bromide, potassium bromide, and potassium iodide; an organic solvent such as ethylene glycol, diethylene glycol, triethylene glycol, dimethylformamide, methyl cellosolve, hexylene glycol, ethanol, and methanol; and an antifoggant, for example, mercapto compounds such as 1-phenyl-5-mercaptotetrazole and sodium 2-mercaptobenzimidazole-5-sulfonate, indazole compounds such as 5-nitroindazole, and benzotriazole compounds such as 5-methylbenzotriazole. Also added are a development promoter as disclosed in Research Disclosure, Vol. 176, No. 17643, Item XXI (December 1978), and if desired, a color toning agent, a surfactant, a debubbling agent, a water softener, and an amino compound as disclosed in JP-A 106244/1981.

Anti-silver-sludging agents may be added to the black-and-white developer in the practice of the present invention, for example, the compounds described in JP-A 24347/1981 and Japanese Patent Publication (JP-B) No. 46585/1981.

To the black-and-white developer may be added amino compounds, for example, the alkanol amines described in JP-A 106244/1981 and EP-A 0136582.

In the practice of the invention, the above-mentioned development is followed by fixation using a fixer which is an aqueous solution containing a thiosulfate at pH 3.8 or higher, preferably pH 4.2 to 7.0.

The fixing agents include sodium thiosulfate and ammonium thiosulfate although the ammonium thiosulfate is preferred for fixing rate. The fixing agent is added in a varying amount, generally from about 0.1 to 3 mol/liter.

The fixer may contain water soluble aluminum salts serving as a hardening agent, for example, aluminum chloride, aluminum sulfate, and potassium alum.

The fixer may contain tartaric acid, citric acid, gluconic acid or derivatives thereof alone or in admixture of two or more. These compounds are effectively added in an amount of at least 0.005 mol per liter of the fixer, especially 0.01 to 0.03 mol/liter.

If desired, the fixer may further contain preservatives (e.g., sulfites and bisulfites), pH buffer agents (e.g., acetic acid and boric acid), pH adjusting agents (e.g., sulfuric acid), chelating agents-capable of softening hard water, and the compounds disclosed in JP-A 78551/1987

In the practice of the invention, silver may be recovered from an overflow of the fixer and it is recommended to do so.

The silver recovery methods include (1) contact of the solution with a metal having a higher ionization tendency than silver (metal replacement), (2) addition of a reagent capable of forming an inert silver salt (precipitation) and reductive precipitation, (4) deposition of silver on a cathode in an electrolytic cell (electrolysis). These methods are discussed in detail in M.L. Schrelbo, "Present Status of Silver Recovery in Motion Picture Laboratories," J. SMPTE., 74. pages 504–514 (1965).

After development and fixation, according to the present invention, the silver halide photosensitive material may be processed with wash water or stabilizer which is replenished at a rate of up to 3 liters per square meter of the photosensitive material (inclusive of 0, that is, pool water washing). It is to be noted that processing with washing water is intended in the illustrated embodiments although processing with stabilizer is acceptable.

Either of the illustrated embodiments utilizes only one washing tank while a multi-stage (e.g., 2 or 3 stage) counterflow mode is well known from the old days as one way of reducing the replenisher amount. The multi-stage counterflow mode is applicable to the present invention whereby the photosensitive material after fixation is washed successively in a gradually cleaner direction, that is, with cleaner solutions contaminated with a less amount of the fixer, resulting in more efficient washing.

In the case of water-saving process or non-piping process, wash water or stabilizer should preferably be provided with antifungal means as previously mentioned.

The antifungal means include UV-ray irradiation as disclosed in JP-A 26393/1985, the use of a magnetic field as disclosed in 263940/1985, the use of an ion-exchange resin to produce pure water as disclosed JP-A 131632/1986, ozone blowing, and the use of antibacterial agents as disclosed in JP-A 115154/1987, 153952/1987, Japanese Patent Application Nos. 63030/1986, 51396/1986, and JP-A 91533/1989.

Also useful is combined use of biocidal agents, antifungal agents and surfactants as disclosed in L.F. West, "Water Quality Criteria", Photo. Sci. & Eng., Vol. 9, No. 6(1965), M.W. Beach, "Microbiological Growths in Motion-Picture Processing", SMPTE Journal, Vol 85 (1976), R.O. Deegan, "Photo Processing Wash Water Biocides", J. Imaging Tech., 10, No. 6(1984), and JP-A 8542/1982, 58143/1982, 105145/1983, 132146/1982, 18631/1983, 97530/1982, and 157244/1982.

The wash water or stabilizer bath may additionally contain microbiocides, for example, the isothiazoline compounds described in R.T. Kreiman, J. Image Tech., 10, 6 (1984), page 242, the isothiazoline compounds described in Research Disclosure, Vol. 205, No. 20526 (May 1981), and the isothiazoline compounds described in ibid., Vol. 228, No. 22845 (April 1983); and the compounds described in Japanese Patent Application No. 51396/1986.

Also useful is $Ag^+$ ion sustained release means.

It may be an amorphous soluble glass containing monovalent silver as disclosed in JP-A 39692/1988, for example.

The amorphous soluble glass is generally formed from at least one network forming oxide selected from $SiO_2$, $B_2O_3$, and $P_2O_5$, at least one network modifying oxide selected from $Na_2O$, $K_2O$, CaO, MgO, BaO, and ZnO, and at least one intermediate oxide selected from $Al_2O_3$ and $TiO_2$ and contains 0.05 to 10 parts by weight, preferably 0.1 to 5 parts by weight of $Ag_2O$.

The amorphous soluble glass becomes gel in water, retains a given amount of $Ag^+$ ions in the gel, and gradually release them into water.

The glass may in a mass, granular or powder form. It is received in a water-permeable sheet container which is placed in water.

The amorphous soluble glass is preferably added to wash water in an amount of 500 to 20,000 g/m$^3$.

Also useful are compounds as described in H. Horiguchi, "Bokin Bobai No Kagaku (Chemistry of Antifungal and Biocidal Agents)", Sankyo Publishing K.K. (1982) and "Bokin Bobai Gijutu Handbook (Antifungal and Biocidal Technical Handbook)", Japan Antifungal and Biocidal Associate, Hakuhodo K.K. (1986).

For washing with a small amount of water, squeeze rollers are preferably used as shown in the figures Exemplary is the squeeze roller washing tank disclosed in JP-A 18350/1988 A washing procedure as disclosed in JP-A 143548/1988 is also preferred.

As water having antifungal means applied thereto is replenished to a washing or stabilizing tank in proportion to the processing quantity, an overflow exits the tank. It is possible to utilize part or all of the overflow as a processing solution having a fixing function in the preceding step as disclosed in JP-A 235133/1985.

"Developing process time" or "developing time" is a duration taken from the point when the leading edge of a photosensitive material is dipped in the developing tank liquid in a processor to the point when it is subsequently dipped in the fixer. "Fixing time" is a duration taken from the point when the leading edge is dipped in the fixing tank liquid to the point when it is dipped in the washing tank liquid (or stabilizer). "Washing time" is a duration when the photosensitive material is dipped in the washing tank liquid.

"Drying time" is a duration-when the photosensitive material passes through the processor drying section where hot air at 35° to 100° C., preferably 40° to 80° C. is usually blown.

In the practice of the invention, the developing time generally ranges from 5 seconds to 3 minutes, preferably from 6 seconds to 2 minutes while the developing temperature ranges from 18° to 50° C., preferably from 20° to 40° C.

In the practice of the invention, the fixing time generally ranges from 4 seconds to 3 minutes at a temperature of about 18° to 50° C., preferably from 5 seconds to 2 minutes at a temperature of about 20° to 40° C.

For water washing (or stabilizing bath), the time generally ranges from 4 seconds to 3 minutes at a temperature of 0° to 50° C., preferably from 5 seconds to 2 minutes at a temperature of 10° to 40° C.

Having finished development, fixation and washing (or stabilization), the photosensitive material is removed of the wash water, that is, squeezed of water through squeeze rollers and then dried as shown in the figures. Drying is generally at about 40° to 100° C. The drying time may vary with the ambient condition, usually in the range of from about 5 seconds to 3 minutes, preferably from about 5 seconds to 2 minutes at 40° to 80° C.

In carrying out development process within 100 seconds on a dry-to-dry basis in a photosensitive material/processing system as mentioned above, it is recommended to provide the developing tank at the outlet with rollers of rubbery material for reducing a development variation inherent to quick processing as disclosed in JP-A 151943/1988, to circulate the developer at a flow rate of 10 m/min. or higher in the developing tank for agitating the developer as disclosed in JP-A 151944/1988, and to effect more intense agitation during processing periods than during standby periods as disclosed in JP-A 264758/1988. For quick processing, rollers are preferably arranged in the fixing tank in an opposed fashion as shown in FIGS. 3 and 5 in order to increase the fixing rate. The opposed roller arrangement reduces the number of rollers used and the volume of the processing tank. That is, the processor can be more compact.

The present invention is also applicable to the processing of photographic silver halide photosensitive material for forming images of ultra-high contrast, high sensitivity photographic properties using hydrazine derivatives as described in U.S. Pat. Nos 4,224,401, 4,168,977, 4,166,742, 4,311,781, 4,272,606, 4,221,857, and 4,243,739.

The hydrazine derivatives used herein include those described in Research Disclosure, Item 23516 (November 1983, page 346) and the literature cited therein, U.S. Pat. Nos 4,080,207, 4,269,929, 4,276,364, 4,278,748, 4,385,108, 4,459,347, 4,560,638, and 4,478,928, British Patent No. 2,011,391B, and JP-A 179734/1985. The hydrazine derivatives are preferably used in an amount of $1\times10^{-6}$ to $5\times10^{-2}$ mol, especially $1\times10^{-5}$ to $2\times10^{-2}$ mol per mol of the silver halide.

The developer used in this processing preferably contains the amino compounds described in U.S. Pat. No. 4,269,929 as a contrast enhancer.

BENEFITS OF THE INVENTION

The process of the present invention can reduce the amount of developer, fixer and other processing solutions replenished and hence, the amount of spent solutions. The present invention ensures that the crossover rollers are fully cleaned without extra cleaning operation even when the replenishment amount is reduced, resulting in ease of maintenance. The overall amount of water used is reduced.

Further, photographic properties are excellent as evidenced by elimination of physical development irregularities.

It is also possible to make the apparatus compact and facilitate solution preparation.

To confirm the above-mentioned benefits, the inventor carried out a variety of experiments, some of which are given below.

Experiment 1

Using an apparatus as shown in FIG. 4, medical radiographic photosensitive materials Super HR-S, HR-A, HR-L, and HR-C manufactured by Fuji Photo-Film Co., Ltd. in an area proportion of about 8:1:1:1 were processed according to the following schedule at a rate of about 200 sheets/day calculated as quarter-size 10×12 inches of sheets.

| Step | Temp. | Time | Replenishment 10 × 12 inches | Tank volume | Opening |
|---|---|---|---|---|---|
| Development (Rinsing) | 35° C. | 13.3 sec. | 15 ml*1) (see below) | 15 l (0.4 l) | 20 cm²/l |
| Fixation (Rinsing) | 32° C. | 11.7 sec. | 15 ml*1) (see below) | 15 l (0.4 l) | 22 cm²/l |
| Washing (Rinsing) | 17° C. | 6.2 sec. | 600 ml (20 ml) | 13 l (0.2 l) | |
| Squeezing | | 6.3 sec. | | | |
| Drying | 58° C. | 7.8 sec. | — | — | |
| Total | | 45.3 sec. | | | |

(line speed 46.1 mm/sec.)
*1)Drag-out by photosensitive material is excluded.

Described below is the preparation of concentrates with which replenishing tanks are charged. The replenishing tanks are polyethylene containers. When a concentrate consists of parts A, B, and C as does a developer concentrate, compartments corresponding to parts A, B, and C are integrated into one assembly.

| Preparation of concentrates | |
|---|---|
| Developer | |
| Part A | |
| Potassium hydroxide | 330 g |
| Potassium sulfite | 630 g |
| Sodium sulfite | 240 g |
| Potassium carbonate | 90 g |

-continued

| Preparation of concentrates | |
|---|---|
| Boric acid | 45 g |
| Diethylene glycol | 180 g |
| Diethylenetriaminepentaacetic acid | 30 g |
| 1-(diethylaminoethyl)-5-mercaptotetrazole | 0.75 g |
| Hydroquinone | 450 g |
| Water totaling to | 4125 ml |
| Part B | |
| Diethylene glycol | 525 g |
| 3,3'-dithio-bis(dihydrocinnamic acid) | 3 g |
| Glacial acetic acid | 102.6 g |
| 5-nitroindazole | 3.75 g |
| 1-phenyl-3-pyrazolidone | 34.5 g |
| Water totaling to | 750 ml |
| Part C | |
| Glutaraldehyde (50 wt/wt %) | 150 g |
| Sodium metabisulfite | 150 g |
| Potassium bromide | 15 g |
| Water totaling to | 750 ml |
| Fixer | |
| Ammonium thiosulfate (70 wt/vol %) | 3300 ml |
| Disodium ethylenediaminetetraacetate dihydrate | 0.45 g |
| Sodium sulfite | 300 g |
| Boric acid | 60 g |
| 1-(N,N-dimethylamino)ethyl-5-mercaptotetrazole | 15 g |
| Tartaric acid | 48 g |
| Glacial acetic acid | 270 g |
| Sodium hydroxide | 90 g |
| Sulfuric acid (36 N) | 58.5 g |
| Aluminum sulfate | 150 g |
| Water totaling to | 7500 ml |
| | pH 4.68 |

Preparation of processing solutions

The developing and fixing tanks wee charged with the above-mentioned concentrates and water int the following proportion so that they served as the developer and fixer.

| | |
|---|---|
| Developer | |
| Part A | 55 ml |
| Part B | 10 ml |
| Part C | 10 ml |
| Water | 125 ml (provided by an overflow from the rinsing tank) |
| pH 10.50 | |
| Fixer | |
| Concentrate | 100 ml |
| Water | 100 ml (provided by an overflow from the rinsing tank) |
| pH 4.65 | |

Washing water there was used city water which was subject to antifungal means by flowing air containing 150 ppm of ozone for 5 minutes at a rate of 4 liter/min. at intervals of 15 minutes.

For the developer, the stock tank (not shown) was partitioned into three compartments which were charged with concentrate parts A, B, and C of the above-mentioned formulations. For the fixer, the stock tank (not shown) was charged with the concentrate of the above-mentioned formulation.

On processing, the developer was replenished by supplying parts A, B, and C from the stock tank at the above-mentioned rate and channeling an overflow from the rinsing tank at the above-mentioned rate to the developing tank where they were agitated. Water was replenished to the rinsing tank between the developing and fixing tanks at a rate of 118.75 ml/10 quarter-size sheets. When expressed in, terms of parts A/B/C, the replenishment was at 41.25/7.5/7.5/118.75 ml of water/10 sheets of 10×12 inches.

The fixer was replenished by supplying water to the associated rinsing tank at a rate of 95 ml/10 quarter-size sheets per 75 ml of the concentrate of the above-mentioned formulation and channeling an overflow from the rinsing tank to the fixing tank.

The washing water was replenished by directly supplying city water and channeling an overflow from the associated rinsing tank.

This is designated Procedure A.

Processing was carried out in the same manner as Procedure A except that the apparatus used was modified to have no rinsing tank installed.

In this case, the developer was replenished by supplying parts A/B/C/water at a rate of 41.25/7.5/7.5/93.75 ml/10 quarter-size sheets. The fixer was replenished by supplying 75 ml the concentrate/75 ml of water/10 sheets of 10×12 inches.

This is designated Procedure B.

Further, processing was carried out in the same manner as Procedure B except that the apparatus used was modified to inject cleaning water against the crossover rollers at the end of daily operation for cleaning as described in JP-A 187243/1988.

This is designated Procedure C.

Furthermore, processing was carried out in the same manner as Procedure B except that rinsing tanks were installed as in Procedure A and overflows of the rinsing tanks were discarded without channeling them to the preceding tanks. In this case, water was replenished to the rinsing tank between the developing and fixing tanks at a rate of 50 ml/10 sheets of 10×12 inches and to the rinsing tank between the fixing and washing tanks at a rate of 30 ml/10 quarter-size sheets This is designated Procedure D.

Procedures A through D were evaluated for the following factors, with the results shown in Table 1.

(1) Contamination of crossover rollers

After cleaning of a crossover roller ceased, the number of cleaning films for cleaning the crossover roller until it became ready for use in processing was examined (2) Spent amount The amount of spent developer was the amount of developer+development-fixation intermediate rinsing solution spent, and the amount of spent fixer was the amount of fixer+fixation washing intermediate rinsing solution spent, and both represented in comparison using Procedure A as a reference.

(3) Silver recovery

Silver recovery was expressed as percentage based on the silver recovery of Procedure A.

(4) Dryness

The above-mentioned Super HR-S was continuously processed and the number of sheets available in dry state was counted.

(5) Washing efficiency

It was expressed by yellowing factor due to residual thiosulfate. The thiosulfate remaining in a film was measured according to the silver nitrate procedure of ISO 417-1977, thereby obtaining yellowing factor (6) Development irregularities Development irregularities were examined and rated as α,Δ, and ×.

α: no irregularities

Δ: some irregularities

×: irregularities

TABLE 1

| Procedure | Number of cleaning films | Cleaning maintenance | Spent solution | Silver recovery (relative) | Dryness | Washing efficiency | Development irregularities |
|---|---|---|---|---|---|---|---|
| A (Invention) | 1 | Unnecessary | (reference) | 100% | 100 sheets | 0.01 | ○ |
| B (Comparison) | 5 | Necessary everyday[1)] | No change | ~86% | 20 sheets | 0.08 | X |
| C (Comparison)[2)] | 2 | Unnecessary | Apparent drop[3)] | ~86% | 20 sheets | 0.03 | X |
| D (Comparison) | 1 | Unnecessary | Increase[4)] | ~100%[5)] | 100 sheets | 0.01 | ○ |

[1)]Necessary to remove rollers for cleaning.

[2)]Cleaning water for crossover rollers should be subject to antifungal means for preventing the conduit from clogging.

[3)]Compared with Procedure A, a 17% drop in development, a 14% drop in fixation, but a washing load increase, meaning an eventual increase of spent solution load (actual drop of silver recovery).

[4)]Compared with Procedure A, a 33% increase in development, a 20% increase in fixation.

[5)]Inefficient silver recovery because of a lower silver concentration and a larger solution amount than Procedure A.

Processing was carried out in accordance with Procedure A, but using the processing apparatus of the FIG. 1 or 3 arrangement, obtaining equally satisfactory results.

Additionally, the processing apparatus of FIG. 4 was modified such that respective replenishers and overflows of respective rinsing tanks are channeled to respective conduits extending from the stock tanks to the developing and fixing tanks and mixed by agitation thereat. With this arrangement, processing was carried out in accordance with Procedure A, but using the developer replenisher from the stock tank and an overflow from the rinsing tank between the developing and fixing tanks as well as the fixers replenisher from the stock tank and an overflow from the rinsing tank between the fixing and washing tanks, obtaining equally satisfactory results.

Experiment 2

(1) Preparation of silver halide emulsion

An appropriate amount of ammonia was added to a container containing gelatin, potassium bromide, and water and heated at 55° C. Then while keeping the reaction contents of pAg 7.60, an aqueous silver nitrate solution and an aqueous potassium bromide solution having a hexachloroiridate (III) added so as to provide a molar ratio of iridium to silver of $10^{-7}$ mol were added to the reaction container by the double jet technique. Two types of monodispersed silver bromide emulsion grains having a means grain size of 0.70 μ and 0.40 μ were obtained by varying the amount of ammonia. The emulsion grains had the distribution that 98% to the entire grains fell within ±40% of the mean grain size. Potassium iodide in an amount of $1\times10^{-3}$ mol/mol of silver was added at the later stage of grain formation. These emulsions were desalted, adjusted to pH 6.2 and pAg 8.6, and then gold an sulfur sensitized with sodium thiosulfate and chloroauric acid, achieving desired photographic performance. The emulsions had a ratio of (100) plane/(111) plane of 93/7 as measured by Kubelka-Munk method.

(2) Preparation of emulsion coating solution

A container containing each 0.5 kg of the two emulsions was heated to 40° C. for dissolving the emulsions, to which 30 cc of a methanol solution of the following infrared band sensitizing dye ($9\times10^{-4}$ mol/1), 130 cc of an aqueous solution of the following supersensitizer ($4.4\times10^{-3}$ mol/1), 35 cc of a methanol solution of the following photosensitive material storage modifier ($2.8\times10^{-2}$ mol/1), an aqueous solution of 4-hydroxy-6-methyl-1,3,3a,7-tetraazaindene, an aqueous solution of dodecylbenzenesulfonate coating aid, and an aqueous solution of polypotassium p-vinylbenzenesulfonate thickener were added, obtaining an emulsion coating solution.

Infrared sensitizing dye

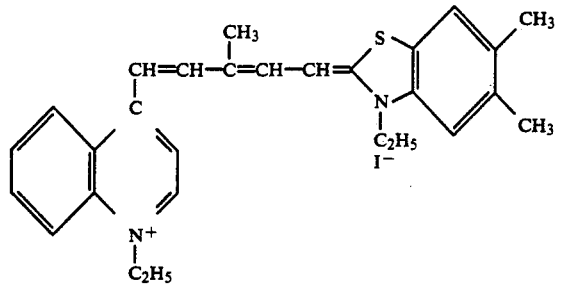

Supersensitizer

Disodium 4,4'-bis[2,6-di(2-naphthoxy)pyrimidin-4-ilamino]stilbene-2,2'-disulfonate

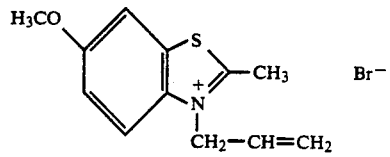

(3) Preparation of coating solution for forming a surface protective layer on the photosensitive layer to an aqueous solution of sodium polystyrene-sulfonate as a thickener, polymethyl methacrylate fine particles (mean particle size 3.0 μm) as a matte agent, N,N'-ethylene-bis(vinylsulfonylacetaamide) as a hardner, an aqueous solution of sodium t-octylphnoxyethoxyethoxyethane-sulfonate as a coating aid, an aqueous solution of polyethylene surfactant as an antistatic agent, and an aqueous solution of fluorinated compounds having the following structures, obtaining a coating solution.

$C_8F_{17}SO_2N(c_3H_7)CH_2COOK$ and
$C_8F_{17}SO_2N(C_3H_7)(CH_2CH_2O)_{15}$-H (4) Preparation of back layer coating solution To an aqueous solution of 10 wt% gelatin, 1 kg, heated at 40° C. were added an aqueous solution of sodium polystyeenesulfonate as a thickener, 50 cc of an aqueous solution of the following back dye ($5\times10^{-2}$ mol/1), an aqueous solution of N,N'-ethylene-bis(vinylsulfonyl-acetamide) as a hardener, and an aqueous solution of sodium t-octylphenoxyethoxyethane sulfonate as a coating aid, obtaining a coating solution.

Back dye

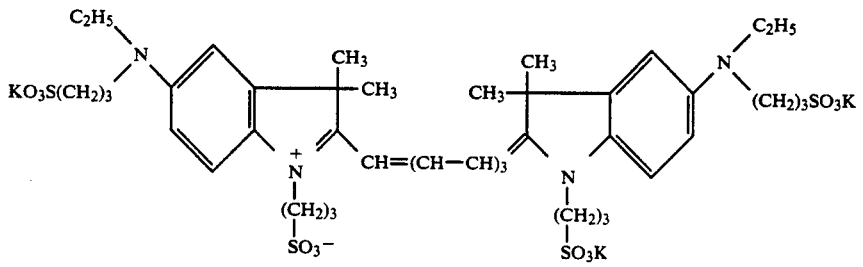

(5) Preparation of coating solution for forming a surface protective layer on the back layer To an aqueous solution of 10 wt% gelatin heated at 40° C. were added an aqueous solution of sodium polystyrenesulfonate as a thickener, polymethyl methacrylate fine particles (mean particle size 3.0 μm) as a matte agent, an aqueous solution of sodium t-octylphenoxyethoxyethanesulfonate as a coating aid, an aqueous solution of polyethylene surfactant as an antistatic agent, and an aqueous solution of fluorinated compounds ofthe following structures, obtaining a coating solution.

$C_8F_{17}SO_2N(C_3H_7)CH_2COOK$ and
$C_8F_{17}SO_2N(C_3H_7)(CH_2CH_2O)_{15}$-H (6) Preparation of coated sample A polyethylene terephthalate support one one surface was coated with the back layer coating solution along with the back layer surface protective layer coating solution to a gelatin coverage of 4 g/m$^2$. Subsequently, the support on the opposite surface was coated with the emulsion coating solution containing near-infrared sensitizing dye as described in (2) along with the surface protective layer coating solution therefore to a silver coverage of 3.2 g/m$^2$ while the hardening agent content of the surface protective layer coating solution was adjusted such that the coating had a welling factor of 160%.

(7) Measurement of swelling factor

The swelling factor is determined by (a) incubating the coated sample at 38° C. and a relative humidity of 50%, (b) measuring the thickness of the layer, (c) dipping the sample in distilled water at 21° C. for 3 minutes, and (d) comparing the thickness of the layer with that measured in (b), calculating the layer thickness change in percentage.

Process

Processing was carried out with the automatic processor shown in FIG. 5.

The developer and fixer concentrates had the following compositions.

| | |
|---|---|
| Developer concentrate | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-hydroxymethyl-4-methyl-1-phenyl-3 pyrazolidone | 13.2 g |
| 5-methylbenzotriazole | 0.2 g |
| Water totaling to 1 liter (adjusted to pH 11.00) | |
| Replenisher kit size | 6 liters |
| Fixer replenisher | |
| Ammonium thiosulfate (70 wt/vol %) | 560 g |
| Sodium sulfite | 60 g |
| Disodium ethylenediaminetetraacetate dihydrate | 0.10 g |
| Acetic acid | 27 g |
| Sodium hydroxide | 24 g |
| Water totaling to 1 liter (adjusted to pH 5.10) | |
| Replenisher kit size | 6 liters |

Processor 45 second processing on dry-to-dry basis

| | | | |
|---|---|---|---|
| Developing tank (11) | 7.5 l | 35° C. | 9.2 sec. |
| Rinsing tank (65) | 300 ml | | |
| Fixing tank (12) | 7.5 l | 35° C. | 10 sec. |
| Rinsing tank (75) | 700 ml | | |
| Washing tank (13) | 6.0 l | 20° C. | 6 sec. |
| Squeeze roller cleaning tank (85) (rinsing tank) | 400 ml | | |
| Drying | | 58° C. | |

At the start of processing, the tanks were charged with the processing solutions shown below.

Developing tank:

A mixture of 333 ml of the developer concentrate, 667 ml of water, and 10 ml of an aqueous solution containing 2 grams of potassium bromide and 1.8 grams of acetic acid was adjusted to pH 10.50.

Fixing tank:

A mixture of 250 ml of the fixer concentrate and 750 ml of water.

Washing tank and rinsing tanks:

city water

Running process was continued for 3 months at a rate of about 100 sheets a day by replenishing 8 ml of the developer concentrate and overflow water from the rinsing tank (65) to the developing tank (11), 18 ml of water to the rinsing tank (65), 4 ml of the fixer concentrate and overflow water from the rinsing tank (75) to the fixing tank (12), 14 ml of water to the rinsing tank (75), and about 500 ml of water from the squeeze roller cleaning tank (85) to the washing tank (13) per B-4 size (25.7 cm×36.4 mm)-sheet of the photosensitive material processed.

In the washing tank, air containing 200 ppm of ozone was blown for 5 minutes at a rate of 3 liter/min. at intervals of 15 minutes through a perforated tube extending on the tank bottom for controlling generation of bio-slime.

During the process, whenever the developer and fixer replenishers were depleted, fresh replenishers were added.

This process achieved equivalent benefits to Procedure A of Experiment 1 while ensuring quite easier daily maintenance.

I claim:

1. An apparatus for processing a photographic silver halide photosensitive material with a processing solution while feeding a replenisher in accordance with the quantity of photosensitive material processed, characterized by comprising a plurality of processing tanks each filled with a processing solution for processing the photosensitive material, a crossover roller between the processing tanks for carrying the photosensitive material, and a rinsing tank filled with cleaning water in which said crossover roller is at least partially immersed, wherein at least a portion of the cleaning water fed to said rinsing tank is used as at least a portion of diluent water necessary to dilute a replenisher concentrate therewith for forming a replenisher to be fed to the processing tank located forward of said rinsing tank.

2. The photographic silver halide photosensitive material processing apparatus of claim 1 wherein said plurality of processing tanks include developing, fixing and washing tanks, the crossover roller and the rinsing tank are disposed between each pair of processing tanks.

3. The photographic silver-halide photosensitive material processing apparatus of claim 2 wherein the amount of the replenisher fed for the developer is up to 0.4 liters per square meter of the photosensitive material.

4. The photographic silver halide photosensitive material processing apparatus of claim 3 wherein the mixing ratio of a replenisher concentrate to the diluent water for the developer replenisher is such that the volume ratio of replenisher concentrate to diluent water may range from 1/0.4 to 1/5.

5. The photographic silver halide photosensitive material processing apparatus of claim 2 wherein the amount of the replenisher fed for the fixer is up to 0.4 liters per square meter of the photosensitive material.

6. The photographic silver halide photosensitive material processing apparatus of claim 5 wherein the mixing ratio of a replenisher concentrate to the diluent water for the fixer replenisher is such that the volume ratio of replenisher concentrate to diluent water ranges may range from 1/0.4 to 1/5.

7. The photographic silver halide photosensitive processing apparatus of claims 1, 2, 3 or 5 wherein the cleaning water constitutes 5 to 100% of the diluent water necessary to dilute a replenisher concentrate.

8. The photographic silver halide photosensitive processing apparatus of claims 1, 2, 3 or 5 wherein the washing water is replenished in an amount of up to 3 liters per square meter of the photosensitive material.

9. The photographic silver halide photosensitive material processing apparatus of claim 2 which includes a drying section disposed aft of said washing tank, a crossover roller and a rinsing tank located between said washing tank and said drying section, wherein at least a portion of the cleaning water fed to said rinsing tank is channeled to said washing tank.

10. The photographic silver halide photosensitive material processing apparatus of claim 9 wherein the cleaning water constitutes 5 to 100% of the amount of washing water replenished.

* * * * *